US005426809A

United States Patent [19]

Muta

[11] Patent Number: 5,426,809

[45] Date of Patent: Jun. 27, 1995

[54] WIPING INSTRUMENT

[75] Inventor: Kouichi Muta, Chiba, Japan

[73] Assignee: Kabushiki Kaisha Hoky, Chiba, Japan

[21] Appl. No.: 116,272

[22] Filed: Sep. 3, 1993

[30] Foreign Application Priority Data

Sep. 4, 1992 [JP] Japan ..... 4-263143

[51] Int. Cl.[6] ..... A47L 13/20

[52] U.S. Cl. ..... 15/228; 15/231

[58] Field of Search ..... 15/228, 105, 114, 118, 15/209.1, 231, 232, 247, 188, 177

[56] References Cited

U.S. PATENT DOCUMENTS

| | | | |
|---|---|---|---|
| 2,414,321 | 1/1947 | Miller | 15/188 |
| 3,012,264 | 12/1961 | Nash | 15/231 |
| 3,034,165 | 5/1962 | Christian | 15/247 |
| 3,054,132 | 9/1962 | Ormerod | 15/247 |
| 3,056,989 | 10/1962 | Murphy | 15/231 |
| 3,261,049 | 7/1966 | Murphy | 15/231 |
| 3,465,377 | 9/1969 | Thomas | 15/231 |
| 3,828,386 | 8/1974 | Roth | 15/105 |
| 4,069,537 | 1/1978 | Matsuo . | |
| 4,071,983 | 2/1978 | Thielen | 15/231 |
| 4,225,998 | 10/1980 | Thielen | 15/231 |
| 4,343,265 | 8/1982 | Belschner | 15/188 |
| 4,811,449 | 3/1989 | Kobayashi . | |
| 5,012,544 | 5/1991 | Verry | 15/231 |

FOREIGN PATENT DOCUMENTS

| | | | |
|---|---|---|---|
| 709237 | 8/1941 | Germany | 15/247 |
| 114620 | 4/1992 | Japan | 15/228 |

*Primary Examiner*—David A. Scherbel
*Assistant Examiner*—Tony G. Soohoo

[57] ABSTRACT

A wiping instrument can clean places which previously have been difficult to clean is arranged such that a ground contact pressure of a wiping cloth per unit area is allowed to increase, and further a wiping cloth on the instrument can scrub the surface to be cleaned so as to follow irregularities existing on the surface to be cleaned. Accordingly, the wiping instrument provides a wiping cloth which is attached to the bottom of a base plate portion provided with a handle. The wiping operation is performed by moving the wiping cloth over a surface to be cleaned. The base plate portion is made of a rigid material and a plurality of elastic projections are erected on substantially all of the surface of the bottom of the base plate portion. The wiping cloth is attached to the bottom of the base plate portion so as to cover a plurality of the elastic projections.

13 Claims, 8 Drawing Sheets

WIPING INSTRUMENT

BACKGROUND OF THE INVENTION

1. Field of the Invention

The present invention relates to a wiping instrument, and more particularly to a wiping instrument for effecting wiping operation to which is attached one of various wiping cloths which are used for wiping such as a cloth having water retentivity, a floorcloth, a chemically processed dustcloth and the like (hereinafter referred to simply as "wiping cloth").

2. Description of the Related Art

Such a wiping instrument, for example, as shown in FIGS. 8 and 9 has been known as a conventional wiping instrument.

This wiping instrument 100 is constructed such that the lower end portion of a rod-like operating handle 102 is attached to a base plate portion 106 made of a rigid material through a universal joint 104. Furthermore, the overall surface in its bottom 106*a* of the base plate portion 106 is formed as a flat surface, and a wiping cloth 108 is detachably attached to the bottom by means of a zipper tape such as Velcro (trademark) or the like.

In case of effecting cleaning operation with respect to a floor surface 200 and the like being a surface to be cleaned by means of the wiping instrument 100 constructed as described above, the bottom 106*a* of the base plate portion 106 to which is attached the wiping cloth 108 is placed on the floor surface 200 by an operator as shown in FIG. 9, and then the base plate portion 106 is moved along the directions A and B indicated by both the arrows in FIG. 9 wherein the handle 102 is held by the operator. Thus, wiping operation is realized by scrubbing the floor surface 200 with the use of the wiping cloth attached to the bottom 106*a* of the base plate portion 106.

In the meantime, since the whole profile in the bottom 106*a* of the base plate portion 106 is in the conventional wiping instrument 100 as described above, pressing force applied to the base plate portion 106 by the operator through the handle 102 is dispersed throughout the whole surface of the bottom 106*a* of the base plate portion 106. As a result, ground contact pressure per unit area of the wiping cloth 108 becomes low in the conventional wiping instrument as described above.

In these circumstances, however, it is known that the stronger force for scrubbing the floor surface 200 by the wiping cloth 108 provides the better wiping effect thereby effectively cleaning stains on the floor surface in wiping operation of stains on the floor surface 200 through the wiping action. In this connection, the higher ground contact pressure per unit area of the wiping cloth 108 provides the stronger force for scrubbing the floor surface 200, whereby wiping operation can efficiently be performed without leaving stains on the floor surface.

However, the conventional wiping instrument 100 involves such a problem that stains and the like stuck to the floor surface 200 cannot be perfectly removed thereby, but remain frequently on the floor surface 200 uncleaned, because of a small contact pressure per unit area of the wiping cloth 108 as described above.

Furthermore, the conventional wiping instrument 100 involves also such a problem that in the case where there are irregularities on the floor surface 200, since the base plate portion 106 is made from a rigid material, the wiping cloth 108 attached to the bottom 106*a* of the base plate portion does not follow the irregularities on the floor surface 200 so that there is a case where all of the floor surface 200 cannot perfectly be scrubbed by the wiping cloth 108. In these circumstances, such places which have not yet been perfectly cleaned remain on the floor surface if irregularities exist on the floor surface 200. Thus there is a case where stains on the floor surface 200 cannot be completely removed.

OBJECT AND SUMMARY OF THE INVENTION

The present invention has been made in view of the various problems involved in the prior art.

An object of the present invention is to provide a wiping instrument wherein a ground contact pressure per unit area of its wiping cloth can be increased to previously prevent incompletely cleaned places from occurring, whereby the cleaning capability thereof is remarkably elevated.

Furthermore, another object of the present invention is to provide a wiping instrument wherein its wiping cloth can follow irregularities on a surface to be cleaned to perfectly scrub all of the surface to be cleaned thereby preventing incomplete cleaned places from occurring and to remarkably elevate the cleaning capability thereof.

In order to attain the above described objects, the wiping instrument according to the present invention is the type wherein a wiping cloth is attached to the bottom of a base plate portion provided with a handle, and wiping operation is performed by causing said wiping cloth to scrub a surface to be cleaned comprising the base plate portion made of a rigid material and a plurality of elastic projections erected on substantially all of the surface of the bottom of said base plate portion, and the wiping cloth being attached to the bottom of said base plate portion so as to cover a plurality of said elastic projections.

According to the present invention, when the base plate portion is slid on a surface to be cleaned by an operator holding the handle, a part of the plural elastic projections erected on the bottom of the base plate portion is forced by pressing force from the handle and reaction force from the surface to be cleaned in response to an advance direction of the base plate portion and an angle of the handle which functions to press the base plate portion against the surface to be cleaned with respect to said surface to be cleaned, whereby the plural elastic projections are elastically deformed and bent. Thus, only the site of the wiping cloth covering the thus elastically deformed and bent site of the elastic projections abuts upon the surface to be cleaned, and as a consequence it becomes possible to make only the site described above to scrub the surface to be cleaned.

More specifically, since the wiping cloth scrubs the surface to be cleaned by receiving the pressing force from the handle, a ground contact area of the wiping cloth contacting with the surface to be cleaned is reduced, and further since it becomes possible to also press the wiping cloth against the surface to be cleaned by means of elastic force of the elastic projections, a ground contact pressure of the wiping cloth per unit area can be remarkably increased. As a consequence, stains and the like stuck to the surface to be cleaned can easily be wiped away without leaving uncleaned places.

Furthermore, in the case where there are irregularities on the surface to be cleaned, the elastic projections which have been elastically deformed and bent as a result of being pressed by the surface to be cleaned follow such irregularities to further deform elastically, so that these elastic projections can repeat expansion and bending thereof. For this reason, a site of the wiping cloth covering the site of elastic projections which have been elastically deformed and bent can scrub positively the surface to be cleaned as a result of following such irregularities on the surface to be cleaned, and thus perfect wiping operation can be effected by the wiping instrument according to the present invention without leaving uncleaned places thereon.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

An embodiment of the present invention will be described in detail hereinbelow in conjunction with the accompanying drawings.

Figure 1:
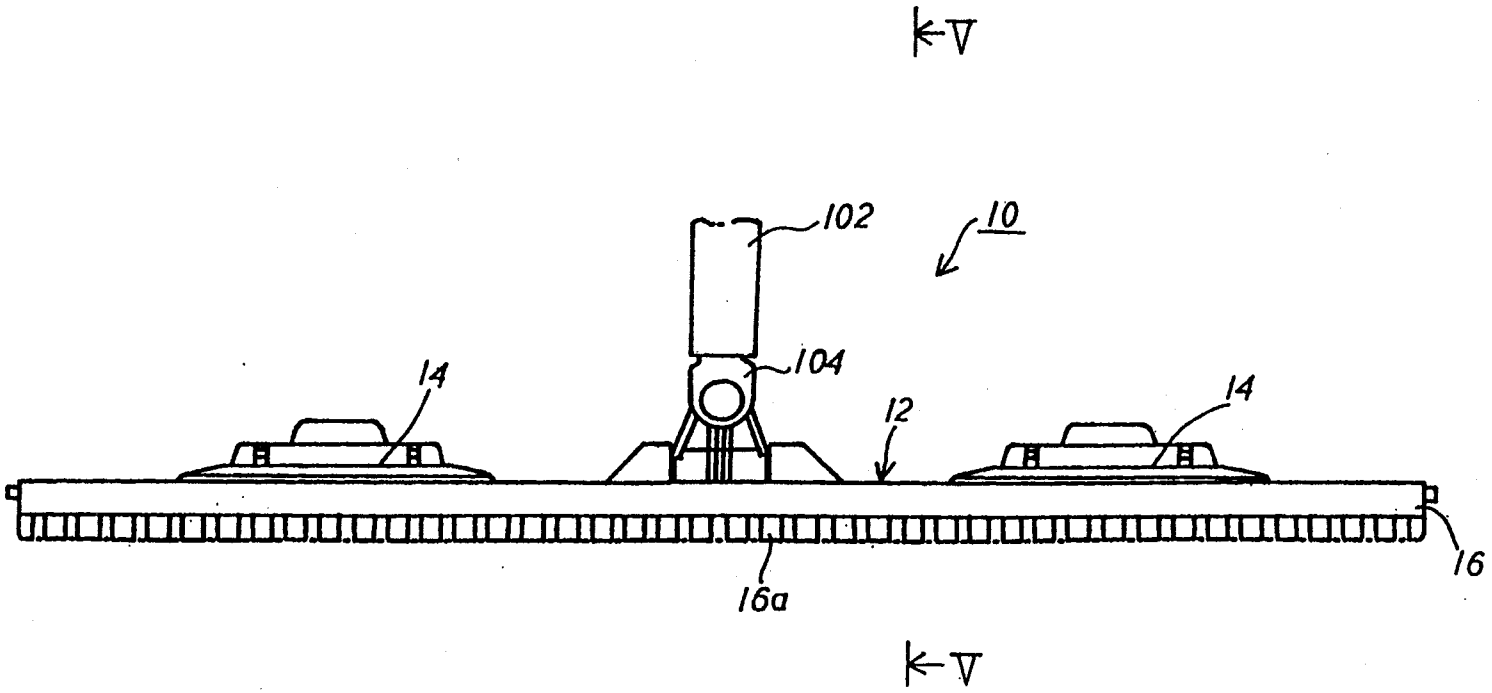
FIG. 1 is a front view showing the wiping instrument according to the present invention in which a wiping cloth has not yet been attached thereto.
Figure 2:
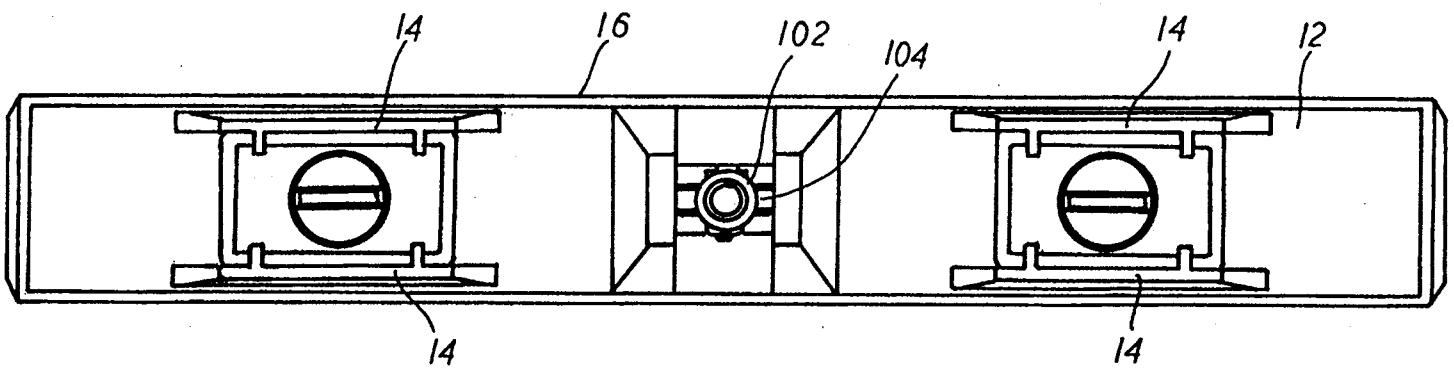
FIG. 2 is a plan view of the wiping instrument shown in FIG. 1.
Figure 3:
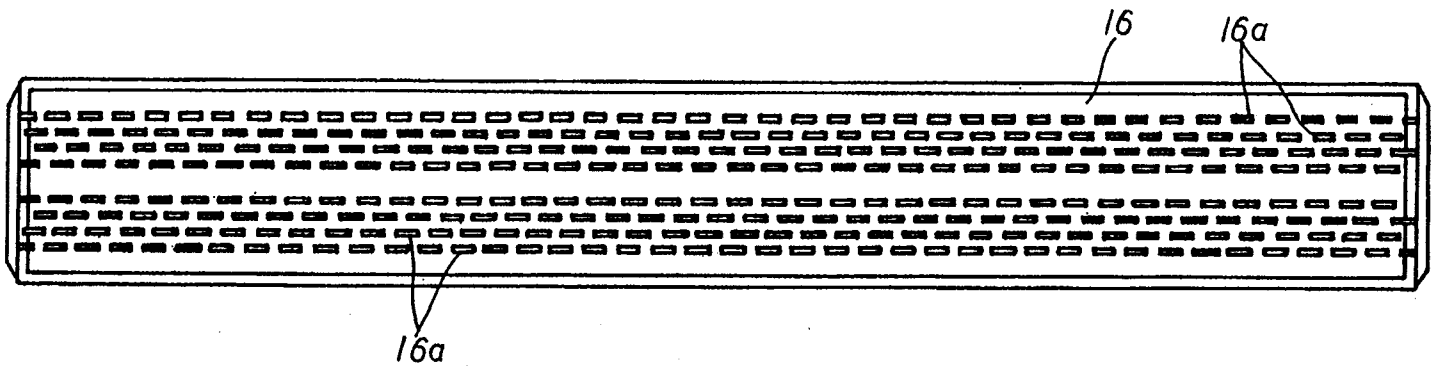
FIG. 3 is a bottom view of the wiping instrument shown in FIG. 1.
Figure 4:
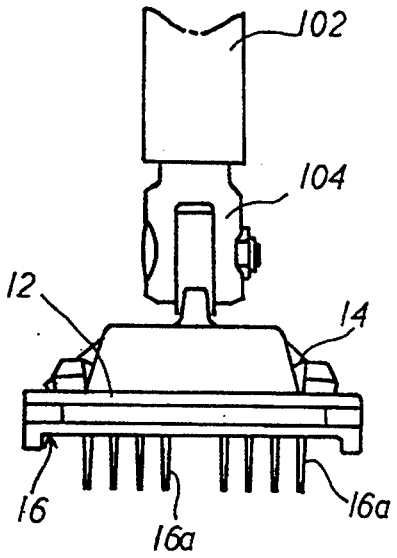
FIG. 4 is a side view of the wiping instrument shown in FIG. 1.
Figure 5:
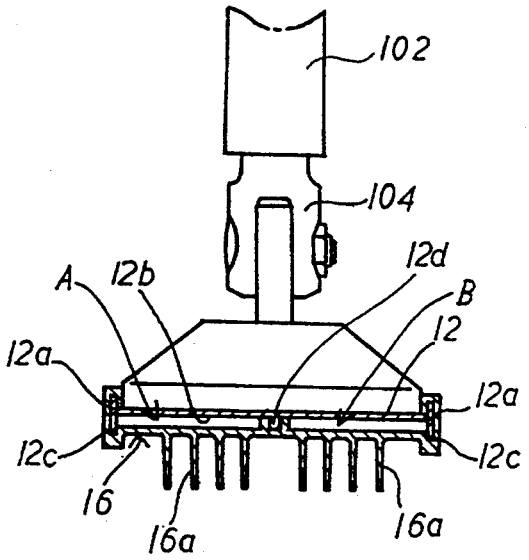
FIG. 5 is a sectional view taken along line V—V of the wiping instrument shown in FIG. 1.
Figure 6:
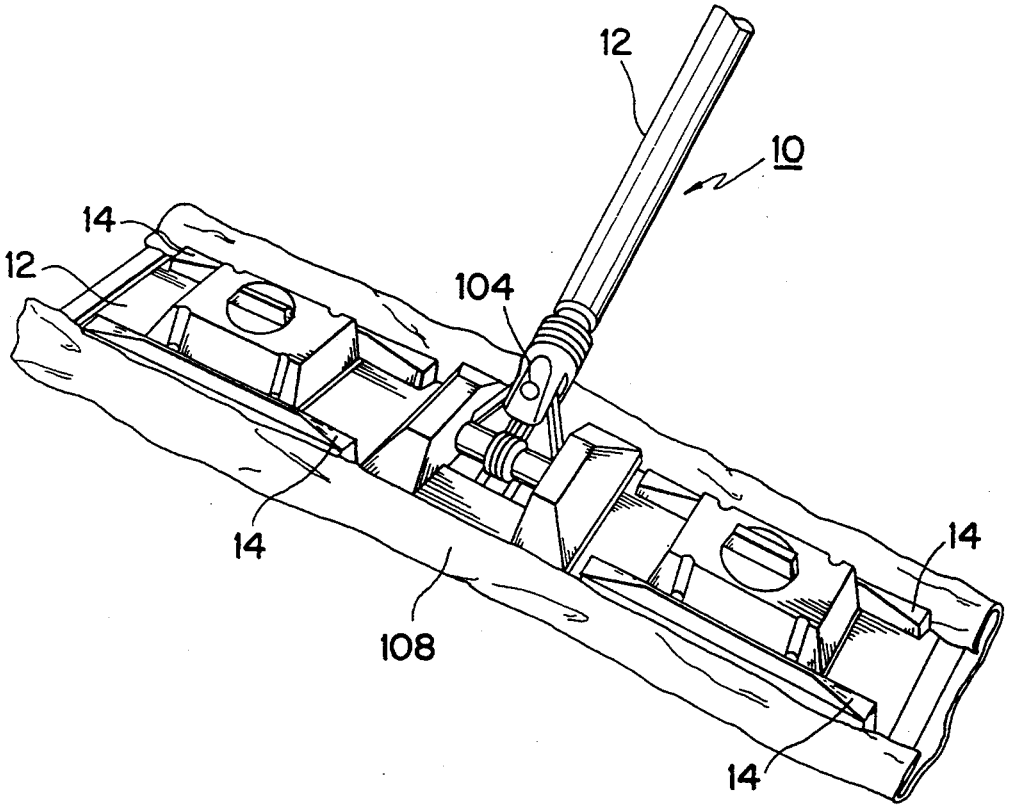
FIG. 6 is a perspective view showing the wiping instrument according to the present invention in which a wiping cloth has been attached thereto.
Figure 7:
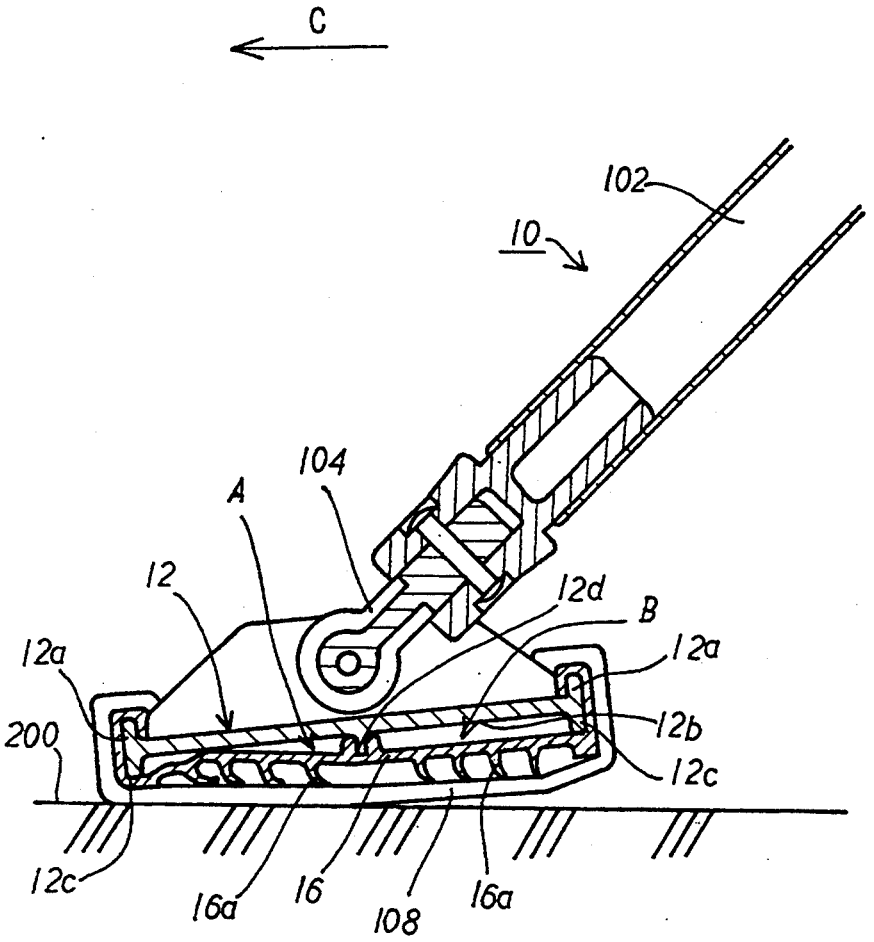
FIG. 7 is a sectional view for explaining functions of the wiping instrument according to the present invention.
Figure 8:
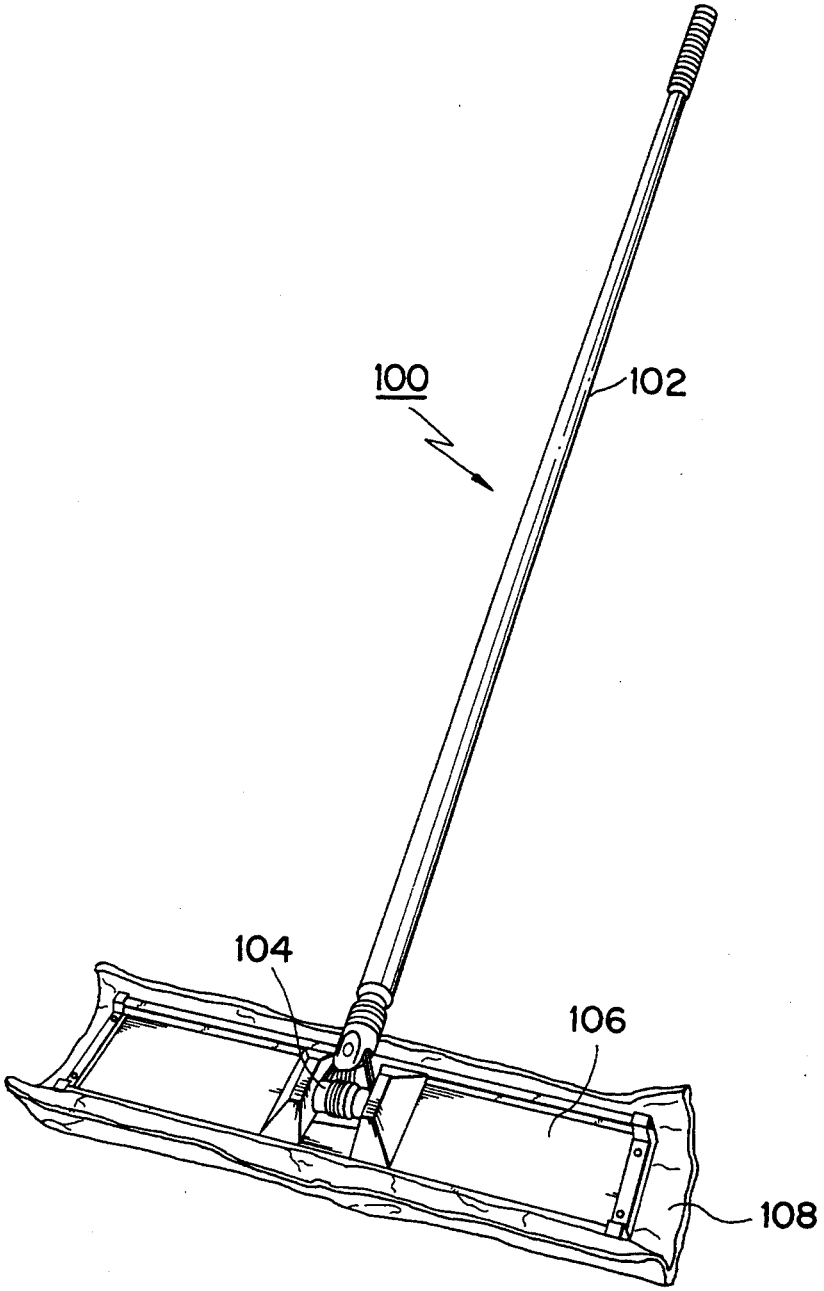
FIG. 8 PRIOR ART
FIG. 8 is a perspective view showing a conventional wiping instrument.
Figure 9:
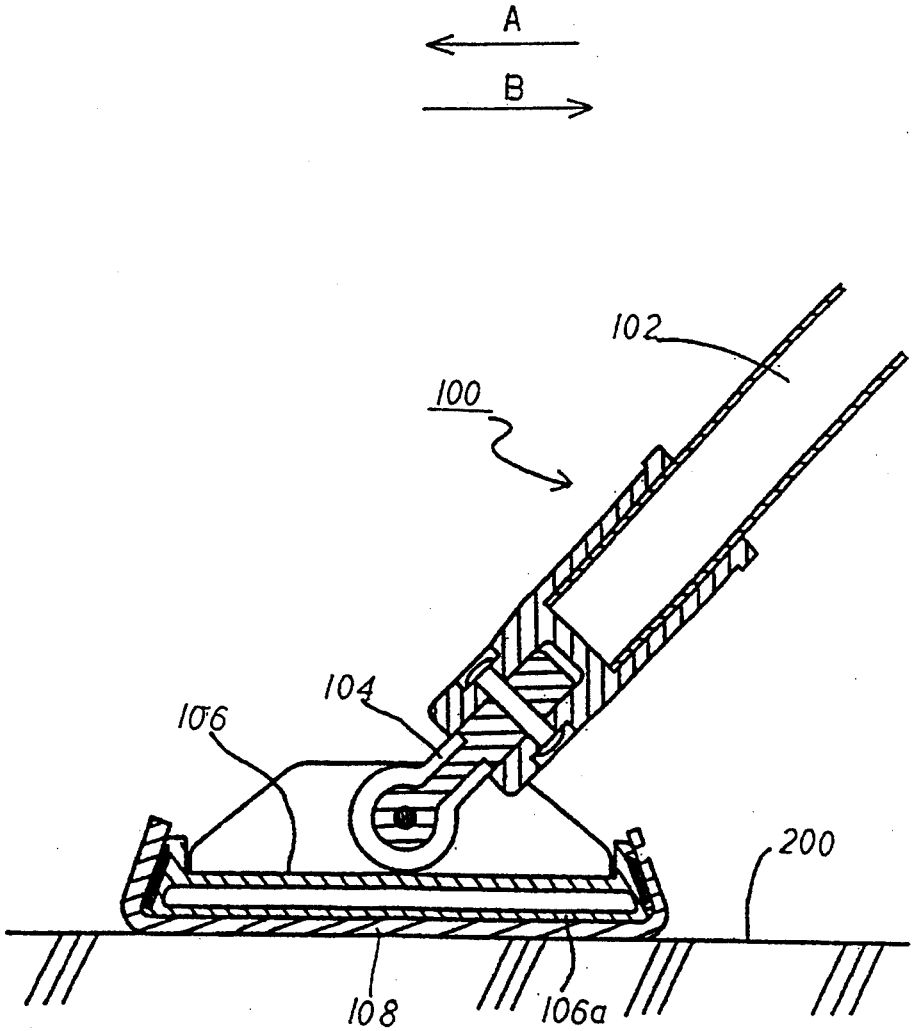
FIG. 9 PRIOR ART
FIG. 9 is a sectional view for explaining functions of the conventional wiping instrument.

FIGS. 1 through 5 indicate a state of the wiping instrument in which a wiping cloth has not yet been attached thereto, respectively, and FIGS. 6 and 7 indicate a state of the wiping instrument in which a wiping cloth has been attached thereto, respectively. Furthermore, it is to be noted that the same or corresponding components of the wiping instrument according to the present invention to those of the conventional wiping instrument shown in FIGS. 8 and 9 are designated by the same reference characters, and in this connection an explanation for the detailed construction and functions of the wiping instrument will be omitted.

A base plate portion 12 of the wiping instrument 10 according to the present invention shown in FIGS. 1 through 7 is made of an aluminum extrusion material which has a substantially flat profile and is located such that the base plate portion 12 in the longitudinal direction thereof is substantially perpendicular to an advance direction of the wiping instrument 10 in case of cleaning a floor surface 200. On the top surface of the base plate portion 12, clamps 14 being composed in accordance with the well-known art and for use in holding a wiping cloth 108 onto the base plate portion 12 are located on the opposite sides with respect to a handle 102, respectively.

Side wall portions 12*a* are oppositely erected with respect to a bottom portion 12*b*, and further the lower end of the side wall portion 12*a* is downwardly projected beyond the bottom portion 12*b* to form an edge portion 12*c*.

Moreover, an elastic member 16 made of rubber or the like is attached to the base plate portion 12 so as to be detachably fitted to the side wall portions 12*a* and to cover the bottom portion 12*b* as well as the edge portions 12*c*, respectively.

More specifically, the elastic member 16 is fitted to both the side wall portions 12*a* so as to cover the edge portions 12*c* on the opposite sides of the base plate portion 12 along the crosswise direction thereof as described above, and also fitted to an engaging portion 12*d* which is downwardly projected from the bottom 12*b* of the base plate portion 12 at a site being substantially intermediate in the crosswise direction of the base plate portion 12. Thus, a spacing A and a spacing B are separately defined by means of the engaging portion 12*d* between the bottom 12*b* of the base plate portion 12 and the elastic member 16 in the longitudinal direction of the base plate portion 12. These spacings A and B are defined with such an extent that elastic deformation of the elastic member 16 is permissible.

Furthermore, a plurality of elastic projections 16*a* are integrally formed on the bottom surface of the elastic member 16. Each of these elastic projections 16*a* is formed with a substantially rectangular profile, and these projections are aligned along the longitudinal direction of the base plate portion 12 with a prescribed spacing, respectively.

In the case when an operator intends to perform wiping operation with the use of the wiping instrument 10 having the above described construction, the wiping cloth 108 is attached to the base plate portion 12 by the operator with the use of the clamps 14 as shown in FIG. 6, and thereafter the base plate portion 12 is made to slide on a floor surface 200 to be cleaned by holding a handle by the operator, whereby the wiping cloth 108 scrubs the floor surface 200.

FIG. 7 shows a state wherein the base plate portion 12 is slid by the operator along the direction of arrow C. In such a condition, a pressing force from the handle 102 is applied to a forward site in the advance direction of the base plate portion 12 with the highest power being dependent upon the advance direction of the base plate portion 12 and an angle of the handle 102 with respect to the floor surface 200. In this connection, the elastic projections 16*a* located at the forward site in the advance direction of the base plate portion 12 are bent as a result of elastic deformation thereof and at the same time, these elastic members 16 come to bend towards the direction of the bottom 12*b* of the base plate portion 12 due to the existence of the spacing A. As a result, only the site of the wiping cloth 108 which covers the elastic projections 16*a* of the elastic material 16 thus bent due to elastic deformation abuts upon the floor surface 200.

For this reason, a contact area defined between the wiping cloth 108 and the floor surface 200 becomes small, so that it makes possible to elevate a ground contact pressure per unit area of the wiping cloth 108 at an extremely high value. Thus, since it is possible to apply a large scrubbing force to be transferred to the floor surface 200 to the wiping cloth 108, a stain and the like stuck to the floor surface 200 can easily be wiped off, whereby there is no place where imperfect cleaning has been done over the whole floor surface 200.

Moreover, in the case where there are irregularities on the floor surface the elastic projections 16*a* can repeatedly be bent and expanded in accordance with the irregularities on the floor surface 200 due to elastic deforming action of the elastic member 16 and the elastic projections 16*a*, respectively, whereby the wiping instrument of the present invention functions to always force the wiping cloth 108 against the surface of the floor 200. Therefore, it is also the case where the wiping cloth 108 scrubs irregularities on the floor surface 200 that an abutting state of the wiping cloth 108 upon the floor surface 200 is always maintained, and consequently there is no imperfect cleaned places on the floor surface 200 by means of such wiping cloth 108.

In addition to the above functions, in the case where stains are stuck very strongly to the floor surface 200 or the like which cannot be cleaned by ordinary scrubbing action with the use of the wiping cloth 108 must be wiped off, it may process such stains by making the wiping cloth 108 to scrub the stained site so as to press forcibly either edge portion 12*c* against the very stained site on the floor surface 200 (in this case another edge portion 12*c* rises to the floor surface 200) as shown in FIG. 7. In accordance with such operation as described above, the stains are scratched off by the edge portion 12*c*, and therefore it becomes possible to positively wipe away strong stains which cannot be cleaned off by usual scrubbing action.

On the other hand, due to elastic deforming action of the elastic member 16 and the elastic projections 16*a* defined on the elastic member 16, various wiping clothes such as the above described cloth having water retentivity, a floorcloth, a chemically processed dustcloth and the like which are used for wiping operation can be attached to the base plate portion 12 without applying forcible tension and the like thereto and further being crumpled, and accordingly durability of such wiping cloth can be elevated.

While in the above described embodiment the explanation has been made as to the case where the base plate portion 12 is slid on the floor surface in only the direction indicated by arrow C in FIG. 7 which is one of the directions along which the base plate portion 12 is movable, if the base plate portion 12 is slid in the opposite direction, the functions thereof are the same as those described above except that only the elastic member 16 and the elastic projections 16*a* on the side of the spacing B are elastically deformed.

Furthermore, each of the elastic projections 16*a* has had a substantially rectangular profile, and they have been aligned along the longitudinal direction of the base plate portion 12 with a prescribed spacing in the present embodiment. In this connection, however, a profile of the elastic projection 16*a* is not limited to a substantially rectangular profile, but may select any arbitrary profile. When needle-like elastic projections are used, the wiping cloth 108 can be held by not planes, but points of them, so that such elastic projections having better following ability with respect to a surface to be cleaned can be obtained.

On one hand, an arrangement of the elastic projections 16*a* is not limited to only the alignment in the longitudinal direction of the base plate portion 12, but it may, of course, be constructed by an arbitrary arrangement.

Since the present invention has been constructed as described above, it provides the following advantages.

In a wiping instrument of the type wherein a wiping cloth is attached to the bottom of a base plate portion provided with a handle, and wiping operation is performed by causing said wiping cloth to scrub a surface to be cleaned comprising the base plate portion made of a rigid material and a plurality of elastic projections erected on substantially all of the surface of the bottom of said base plate portion, and the wiping cloth being attached to the bottom of said base plate portion so as to cover a plurality of said elastic projections, when the base plate portion is slid on a surface to be cleaned by an operator holding handle, a part of the plural elastic projections erected on the bottom of the base plate portion is forced by pressing force from the handle and reaction force from the surface to be cleaned in response to an advance direction of the base plate portion and an angle of the handle which functions to press the base plate portion against the surface to be cleaned with respect to said surface to be cleaned, whereby the plural elastic projections are elastically deformed and bent, so that only the site of the wiping cloth covering the thus elastically deformed and bent site of the elastic projections abuts upon the surface to be cleaned, and as a consequence it becomes possible to make only the site described above scrub the surface to be cleaned.

More specifically, since the wiping cloth scrubs the surface to be cleaned by receiving the pressing force from the handle, a ground contact area of the wiping cloth contacting with the surface to be cleaned can be reduced, and further since it also becomes possible to press the wiping cloth against the surface to be cleaned by means of also elastic force of the elastic projections, a ground contact pressure of the wiping cloth per unit area is remarkably increased, and as a consequence stains and the like stuck to the surface to be cleaned are easily wiped away without leaving uncleaned places.

Furthermore, in the case where there are irregularities on the surface to be cleaned, the elastic projections which have been elastically deformed and bent as a result of being pressed by the surface to be cleaned follow such irregularities to further deform elastically, so that these elastic projections can repeat expansion and bending thereof. For this reason, a site of the wiping cloth covering the site of elastic projections which have been elastically deformed and bent can scrub positively the surface to be cleaned as a result of following such irregularities on the surface to be cleaned. Thus, even if there are irregularities on the surface to be cleaned, perfect wiping operation can be effected by the wiping instrument according to the present invention without leaving uncleaned places thereon.

Therefore, according to the wiping instrument of the present invention, a ground contact area of the wiping cloth per unit area can be increased, and at the same time it becomes possible to make the wiping cloth follow a state of irregularities on the surface to be cleaned, whereby occurrence of uncleaned places can be prevented and its cleaning capability can be remarkably elevated.

It will be appreciated by those of ordinary skill in the art that the present invention can be embodied in other specific forms without departing from the spirit or essential characteristics thereof.

The presently disclosed embodiments are therefore considered in all respects to be illustrative and not restrictive. The scope of the invention is indicated by the appended claims rather than the foregoing description, and all changes that come within the meaning and range of equivalents thereof are intended to be embraced therein.

What is claimed is:

1. A wiping instrument movable over a surface to be cleaned comprising:

a base plate portion made of a rigid material having a downward extending engaging portion;

an elastic covering member detachably disposed on a bottom of the base plate portion, said engaging portion attached to said elastic covering member to provide a prescribed spacing therebetween, the elastic covering member having a generally flat bottom surface portion;

a plurality of elastic projections extending from said bottom surface portion of the elastic covering member; and a wiping cloth covering the bottom of the elastic covering member and covering the plurality of elastic projections, the wiping cloth being attached to the base plate.

2. The wiping instrument as claimed in claim 1, wherein said base plate portion further having sidewall portions and downwardly protruded edge portions formed on said side wall portions.

3. The wiping instrument as claimed in claim 2, wherein said elastic projections have a needle-like profile.

4. The wiping instrument as claimed in claim 1, wherein said elastic projections have a needle-like profile.

5. The wiping instrument as claimed in claim 1, wherein, the engaging portion divides the prescribed spacing into two chambers.

6. The wiping instrument as claimed in claim 5, wherein the two chambers are positioned between the elastic covering member and the base plate, the elastic covering member being deformable to reduce size of one of the chambers.

7. The wiping instrument as claimed in claim 6, wherein the wiping cloth engages the surface to be cleaned and wherein a surface area of the wiping cloth which engages the surface to be cleaned is reduced upon deformation of the elastic covering member.

8. The wiping instrument as claimed in claim 1, wherein the plurality of projections are positioned on the bottom of the elastic covering member in a plurality of rows, the projections being staggered between adjacent rows.

9. The wiping instrument as claimed in claim 1, wherein two groups of projections are provided on the bottom of the elastic covering member and wherein three rows of projections are provided in each group, the projections in adjacent rows being staggered.

10. The wiping instrument as claimed in claim 1, wherein the base plate has side wall portions which are enclosed by the elastic covering member when the covering member is located on the bottom of the base plate portion.

11. The wiping instrument as claimed in claim 1, wherein each of the elastic projections has a longitudinal axis and wherein the elastic projections are deformable upon pressing of the wiping instrument against the surface to be cleaned, the longitudinal axes of the projections which are deformed having a generally c-shape during deformation and being generally linear when the elastic projections are undeformed.

12. The wiping instrument as claimed in claim 1, wherein size of the prescribed spacing is reduced when the elastic projections are deformed.

13. The wiping instrument as claimed in claim 1, wherein the elastic projections are deformable and wherein size of the prescribed spacing is reduced when the elastic projections are deformed.

* * * * *